US005951057A

United States Patent [19]

Spector

[11] Patent Number: 5,951,057

[45] **Date of Patent: *Sep. 14, 1999**

[54] GREETING CARD HAVING REMOVABLE DECAL SECTION

[76] Inventor: Donald Spector, 380 Mountain Rd., Union City, N.J. 07087

[ * ] Notice: Under 35 U.S.C. 154(b), the term of this patent shall be extended for 18 days.

[21] Appl. No.: 08/579,588

[22] Filed: Dec. 26, 1995

[51] Int. Cl.[6] ..... B42D 15/00

[52] U.S. Cl. ..... 283/117; 2/246; 40/124.1; 229/92.8; 428/914

[58] Field of Search ..... 283/117; 40/124.1, 40/594; 229/92.8, 92.3; 428/914; 2/246

[56] References Cited

U.S. PATENT DOCUMENTS

| | | | |
|---|---|---|---|
| 4,048,740 | 9/1977 | Zitzelberger et al. | 40/158.1 |
| 4,089,722 | 5/1978 | Holoubek | 156/235 |
| 4,200,222 | 4/1980 | Feuer | 229/92.8 |
| 4,224,358 | 9/1980 | Hare | 427/147 |
| 4,439,941 | 4/1984 | Halperin | 40/124.1 |
| 4,515,838 | 5/1985 | Miyajima | 40/124.1 X |
| 4,652,239 | 3/1987 | Brimberg | 428/43 |
| 4,704,535 | 11/1987 | Leber et al. | 250/372 |
| 5,102,171 | 4/1992 | Saetre | 283/117 |
| 5,495,644 | 3/1996 | Mesher | 24/3.12 |
| 5,498,455 | 3/1996 | Roberts | 428/41.8 |

FOREIGN PATENT DOCUMENTS

| | | | |
|---|---|---|---|
| 0189817 | 8/1986 | European Pat. Off. | 283/117 |
| 1456907 | 10/1966 | France | 283/117 |
| 2122544 | 1/1984 | United Kingdom | 283/117 |
| 8801419 | 2/1988 | WIPO | 283/117 |

*Primary Examiner*—Andrea L. Pitts
*Assistant Examiner*—Monica Smith
*Attorney, Agent, or Firm*—Michael Ebert

[57] ABSTRACT

A greeting card on which is printed a message addressed to its recipient by an established character, such as a well-known cartoon figure. The card includes a detachable decal section having printed thereon an image of the character. The decal section is printed with a transferable ink, the remainder of the card being printed with a non-transferable ink. The decal section constitutes a gift from this character to the recipient who can detach this section and transfer the image thereon to a surface receptive to a transferable ink which may be of the heat or water tranferable type.

15 Claims, 3 Drawing Sheets

GREETING CARD HAVING REMOVABLE DECAL SECTION

BACKGROUND OF INVENTION

1. Field of Invention

This invention relates generally to greeting cards, and more particularly to a greeting card having a detachable decal section carrying an image printed in a transferrable ink that can be transferred to a surface receptive to this ink.

2. Status of Prior Art

In the toy and plaything industry, the term "character" is applicable to an established personality, human or imaginary, who is widely known. This character may be a universally-familiar cartoon figure, such as Popeye or Mickey Mouse, a movie or TV comic, such as Harpo Marx or Milton Bearle, a rock star, such as Madonna, or any recognizable personality.

Such characters play an important merchandising role, for a plaything that bears an image of a particular character and is seemingly endorsed by that character is more likely to sell than the same plaything lacking this endorsement. Hence many toys and other articles of merchandise are sold under a "Character License" which authorizes the manufacturer to link the licensed character with his products.

The present invention relates to greeting cards which are character-based and include a detachable decal section having an image of the character printed thereon that is transferable to a T-shirt or other article or surface receptive to a transferable printing ink.

The Stuart U.S. Pat. No. 5,284,365 shows a greeting card having a cut out containing a removable message section that can be removed from the basic greeting card, and by means or adhesive of magnetic material, applied to a surface. But the message on this section is not heat-transferable. The Saetre U.S. Pat. No. 5,102,171 shows a greeting card having a peel-off sheet formed of static cling vinyl on which an image is printed. This sheet may be attached by electrostatic attraction to a non-porous surface.

The Hare U.S. Pat. No. 4,224,358, discloses a kit for applying colored emblems to T-shirts. The kit includes a transfer sheet having printed thereon an outline of the emblem to be transferred. Also provided are color crayons of heat-transferable wax which are used to color in the emblem so that the colored emblem can be heat-transfered to a T-shirt.

The Holoubek patent U.S. Pat. No. 4,089,722 points out that heat transfer sheets have been widely used to apply figures, pictures, designs and words to T-shirts and other articles of apparel. The transfer sheet for this purpose uses an ink that includes a resinous plastisol and colorants. When the transfer sheet is laid down on a T-shirt and a heated iron is applied thereto, the resionous ink then liquifies and is absorbed by the fabric fibers of the T-shirt.

In Holoubek, the transfer sheet is a strip that is perforated to form tear off sections. Each section has a letter of the alphabet printed thereon in heat-transferable ink. Thus if one wishes to apply the word CAT to a T-shirt, one uses for this purpose the three tear-off sections having the letters C, A and T printed thereon in heat-transferable ink.

SUMMARY OF INVENTION

In view of the foregoing, the main object of the invention is to provide a greeting card having a detachable dacal section which has an image of a character printed thereon in a transferable ink, so that the image from the detached section may be transferred to a T-shirt or other article or surface receptive the transferable ink.

A significant feature of the invention is that the greeting card may be addressed to the recipient by a character known to the recipient, the image on the detachable decal section being that of this character. Hence when the character's image is transferred to a T-shirt, the T-shirt is in effect a gift from the character.

Should the greeting card contains a birthday greeting from a character to a recipient who is a child, the child not only receives a message from this character for whom he has affection, such as Mickey Mouse, but also a birthday present from Mickey Mouse. This contributes to the birthday experience, for the child is not only is the recipient of a birthday greeting seemingly from Mickey Mouse, but he also receives a birthday present which he can wear and show to his friends.

More particularly, an object of this invention is to provide a greeting card in a folder format whose top page carries an image of the character and a message appropriate to the occasion, and whose back page includes a detachable decal section having printed thereon in a transferable ink an image of the same character.

Also an object of the invention is to provide a greeting card whose decal section is printed in a water transferable ink with a simulated tattoo that is transferable to a skin surface of an individual.

Briefly stated, these objects are attained by a greeting card on which is printed a message addressed to the recipient by an established character, such as a well-known cartoon figure. The card includes a detachable decal section having printed thereon an image of the character. The decal section is printed with a transferable ink, the remainder of the card being printed with a non-transferable ink. The decal section constitutes a gift from this character to the recipient of the card who can detach this section and transfer the image thereon to a surface receptive to the transferable ink which may be of the heat-transferable or water-transferable type.

BRIEF DESCRIPTION OF INVENTION

For a better understanding of the invention reference is made to the following description to be read in conjunction with the accompanying drawing wherein.

DESCRIPTION OF INVENTION

First Embodiment

Figure 1:
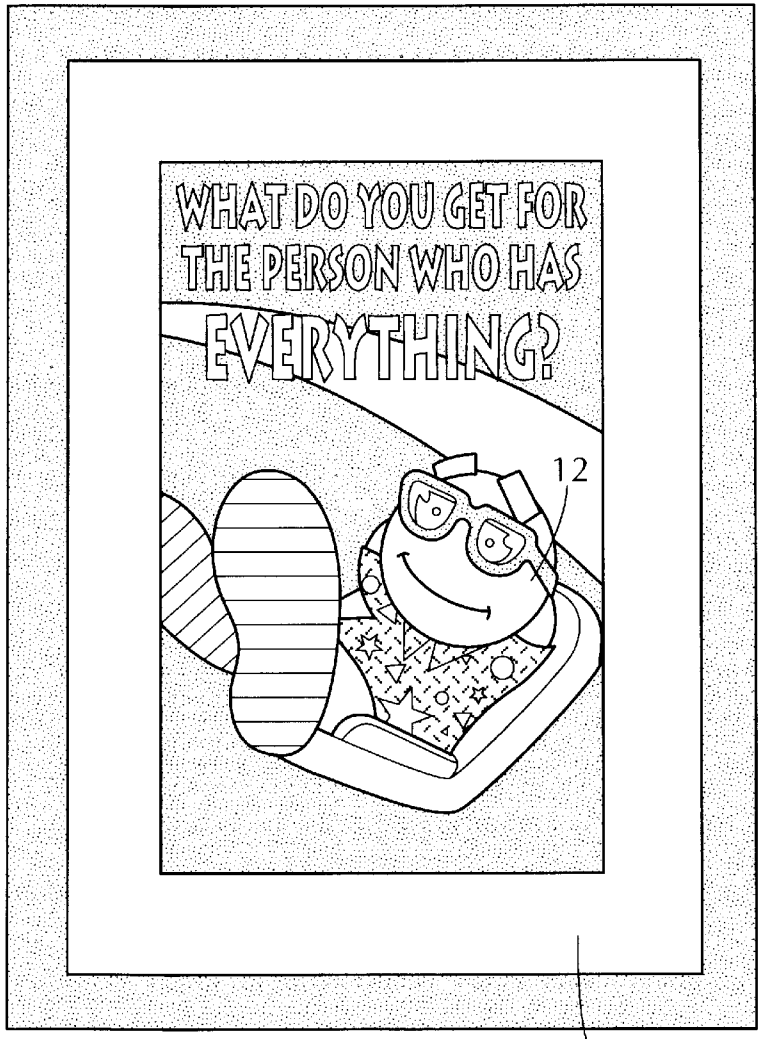
FIG. 1 is a perspective view of a first embodiment of folder-type greeting card in accordance with the invention which makes use of a heat-transferable ink.

Referring now to FIG. 1, there is shown a greeting card in a folder format in accordance with a first embodiment the invention having a printed front page 10 hinged to a printed back page 11 of the same rectangular size. To manufacture this folder-type greeting card, both sides of a single sheet are printed, one side having page 10 printed thereon and the other side, back page 11, the sheet then being folded in half. For this purpose be make of a sheet of heavy paper or paperboard stock suitable for to a greeting card to be inserted in an envelope addressed to the recipient of the card.

By way of illustration, the greeting card shown in the drawing is a birthday greeting from a character known as Mr. Balzac whose image 12 is printed on the front page 10. Mr. Balzac is a character well-known in the toy and plaything field, for BALZAC is the trademark of a spherical play ball formed by an outer casing within which is an inflated ballon. The character, Mr. Balzac, is related to the BALZAC playball, for he has a perfectly spherical head on a gnome-like body.

The illustrated greeting card is in a birthday greeting in which on the front page 10 of the card Mr. Balzac asks its recipient "WHAT DO YOU GET FOR THE PERSON WHO HAS EVERYTHING?" Printed on the front page is an image of Mr. Balzac sitting in a chair. The entire front page 10 is multi-color printed in standard, non-tranferable printing inks.

Figure 2:
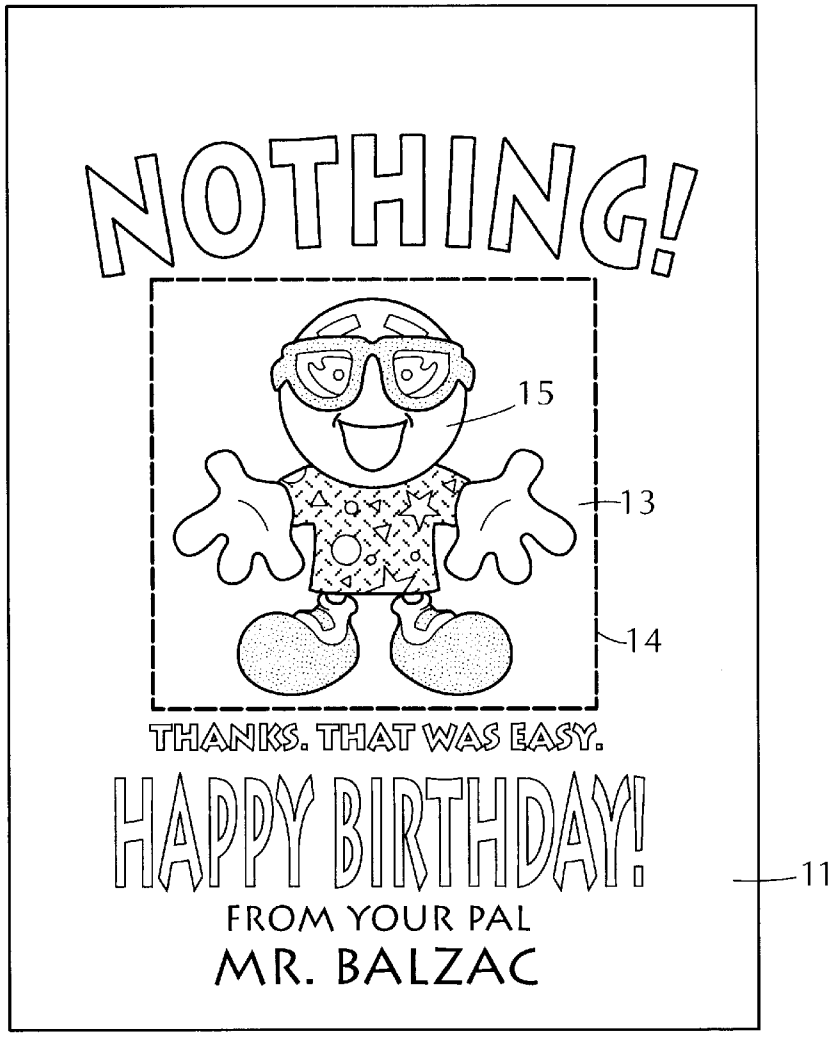
FIG. 2 shows the back page of the greeting card.

As shown in FIG. 2, Mr. Balzac's question is answered on back page 11 which is not seen until the card is unfolded. The answer is "NOTHING!—this being followed by "THANKS. THAT WAS EASY." and by "HAPPY BIRTHDAY from Your Pal, Mr. BALZAC," also printed in ordinary ink.

In the central region of the back page 11 is a square decal section 13 which is rendered detachable by perforations 14 in a square pattern, so that the decal section may be separated from the back page. In practice, instead of perforations, use may be made of score lines to weaken the paper or paperboard from which this page is made so that the decal section can easily be detached from this page.

Printed in a heat-transferable ink on the decal section 13 is an image 15 of Mr. Balzac. The heat transferable ink may be a resinous plastisol and colorants, or of any other known type which liquifies when heat is applied thereto.

Figure 4:
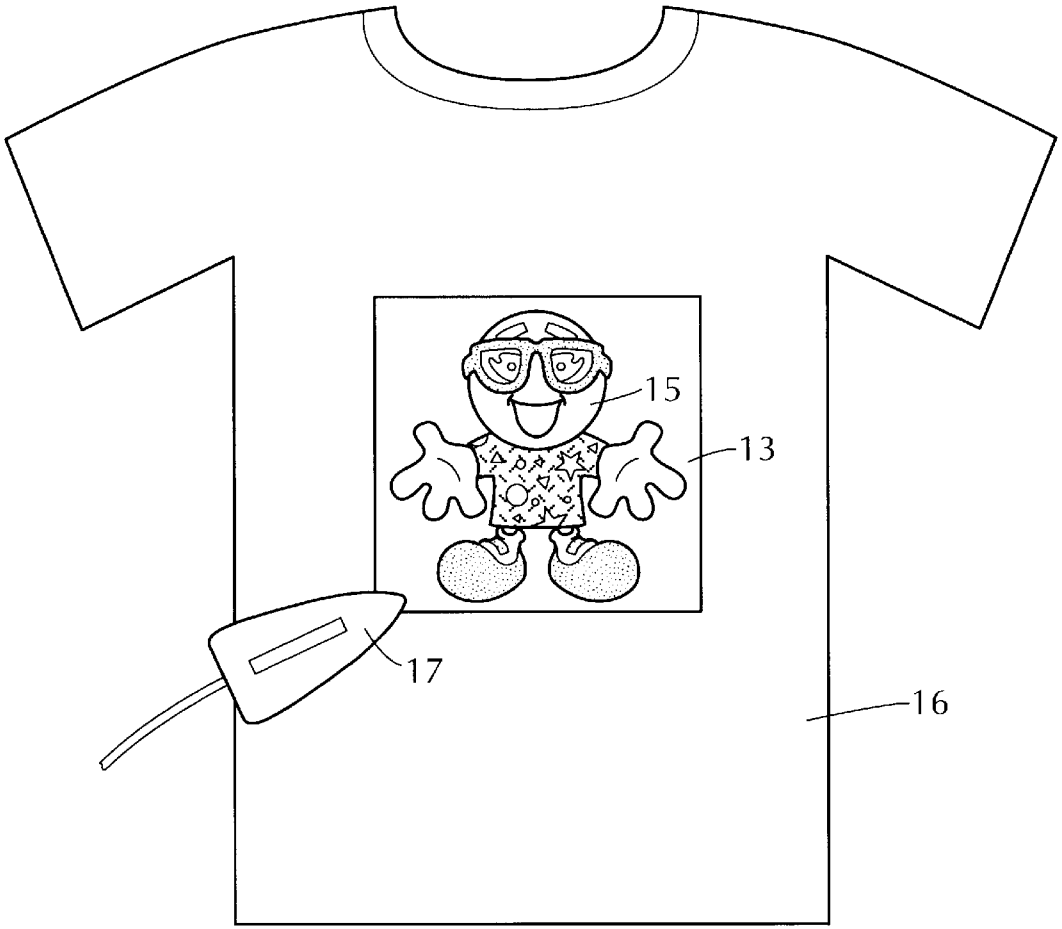
FIG. 4 shows the decal section being heat-transferred to a T-shirt.
Figure 3:
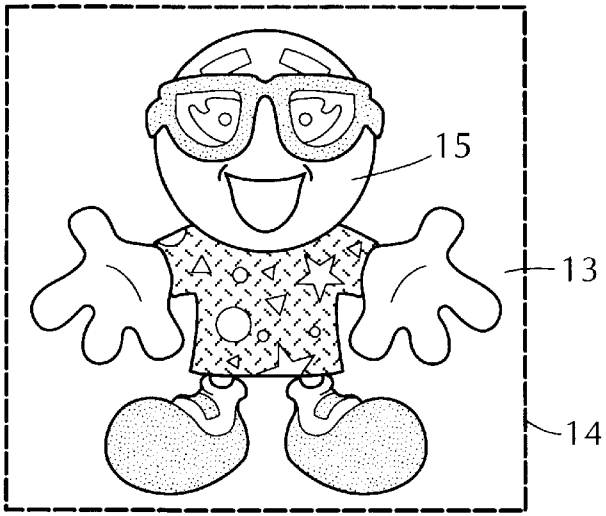
FIG. 3 shows the decal section of the greeting card after it has been removed from the back page.

In order to heat-transfer this image onto a T-shirt or other article receptive to a heat-transferable ink, decal 13 is removed from the rear page, as shown in FIG. 3. It is then, as shown in FIG. 4, placed on the front panel of a T-shirt 16, and by means of a hot iron 17 which is pressed over the decal, the image on the decal is transferred to the fabric fibers of the T-shirt, the liquified ink being absorbed by the fibers.

When the image 15 of Mr. Balzac is printed on the front face of the of back page 11 in heat-transferable ink, and and the decal is then removed from the back page and laid down on T-shirt 16, the printed side of the decal must then in contact with the T-shirt.

However, one may print Mr. Balzac in ordinary ink on the front face of back page 11 and on the rear face of the back page, print the identical image of Mr. Balzac in heat-transferable ink. Hence the decal section 13 will have the same image printed on both sides, only the rear face of this section being printed in heat-transferable ink.

The advantage of a double-faced decal of this type is that when laid down on a T-shirt, one then sees the image of Mr. Balzac and therefore knows the position he will occupy on the T-shirt or other surface onto which the image is transferred.

Second Embodiment

Figure 5:
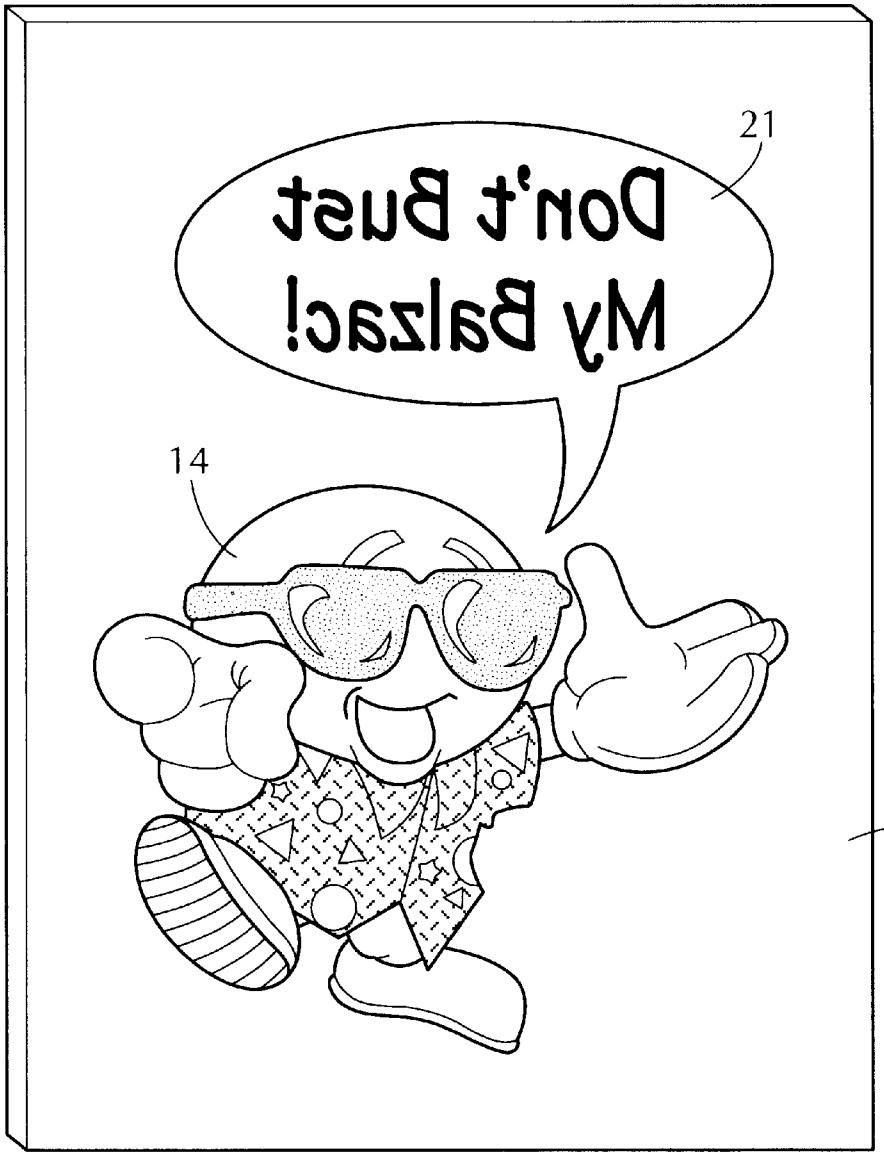
FIG. 5 shows the decal section of a second embodiment of the invention which makes use of a water-tranferable ink.

FIG. 5 illustrates only the detachable decal section 18 of a greeting card similar to that of the first embodiment shown in FIGS. 1 to 4, except that the transferable ink image of Mr. Balzac is printed not in heat-transferable inks but in water-transferable inks. This makes it possible to transfer a design or image to a surface onto which one cannot apply heat to effect a transfer.

Decal section 18 may be used to impress a simulated tattoo on the skin surface of an individual or on any other surface that cannot tolerate heat. A genuine tattoo is a permanent design or image made on the skin by a process of pricking and ingraining an indelible pigment. Once this tattoo is created on the skin it cannot be removed therefrom except by surgery. A simulated tattoo is created by an inked design or image impressed on the skin surface which will adhere thereto, but can later be removed, the skin surface not being pricked or otherwise impaired.

To render decal section 18 which is formed of paper stock receptive to the inks which create a simulated tattoo image which in the example shown is an image 19 of Mr. Balzac, the surface of the paper is coated with a water-soluble adhesive layer 20 which may be a water-based acrylic or a starch of the type used in mailing envelopes.

It is to be noted that the image 19 of Mr. Balzac has a balloon linked thereto having a message printed thereon and is not readable until the message is tranferred to a skin surface.

The simulated tattoo inks forming the image are printed on the water-soluble adhesive layer 20, the inks having an affinity for the surface to which the tattoo is to be applied.

Suitable inks for the purpose may include PVA copolymer, polyester resin, varnish, deodorized petroleum, silicon dioxide, aluminum silicate, iron oxide and coloring agents which are FDA certified, such as FD and C Yellow 5 and 6, Aluminum Lake, D and C Red 7 Lake, and FD and C Blue 1.

In applying decal 18 to a skin surface, the skin should be clean and dry, and also free of hair. The decal is placed with its printed face down on the skin and pressed firmly against the skin surface. Then the back of the paper decal is made thoroughly wet with a damp sponge whose water is absorbed by the paper to dissolve the water-soluble adhesive layer 20.

As a consequence, the printed tattoo image which is pressed against the skin surface is released from the dissolved adhesive layer 20 of the decal section and transferred to the skin surface.

To later remove the simulated tattoo image from the skin surface or whatever other surface to which the tattoo is applied, this can be done with an adhesive tape or by rubbing the surface with alcohol or baby oil.

While there has been shown and described a preferred embodiment of a greeting card having a removable decal section, it will be appreciated that many changes and modifications may be made therein without, however, departing from the essential spirit thereof.

In practice, the greeting card may be of any type, such as a Xmas card in which the character is dressed as Santa Claus and carries a printed message appropriate to this holiday.

And instead of a greeting card in a folder format, the card may take the form of a single rectangular card having a removable decal section.

I claim:

1. A greeting card for a given occasion having printed thereon a message appropriate to the occasion addressed to a recipient of the card by an established cartoon figure character, said card comprising a detachable decal section integral with the card on which is printed an image of the character in a transferable ink, and a remaining section of the card on which is printed said message in a non-transferable ink, whereby when the recipient receives the message and the decal section is removed from the card, the image thereon may then be transferred to a surface receptive to the transferable ink to provide the recipient with a gift from the character.

2. A greeting card as set forth in claim 1, in which the transferable ink is a heat-transferable ink, the image being transferred to the surface by placing the decal section on the surface and applying heat to the decal section.

3. A greeting card as set forth in claim 2, in which the heat-transferable ink includes a resinous plastisol and a colorant.

4. A greeting card, as set forth in claim 1, in which an image of the character is also printed in non-transferable ink on the remainder remaining section of the card.

5. A greeting card as set forth in claim 1, in which said decal section is perforated so that it is removable from the card.

6. A greeting card as set forth in claim 1, in a folder format having a front page and a back page which is readable only when the card is unfolded, said removable decal section being included in the back page.

7. A greeting card as set forth in claim 6, in which the front page has printed thereon in non-transferable ink an image of the same character.

8. A greeting card as set forth in claim 7, in which said front page has printed thereon a question addressed to the recipient of the card, and the back page has printed thereon an answer to the question.

9. A greeting card, as set forth in claim 8, in which said decal section has said character image printed thereon in heat-transferable ink on its rear surface, the same image being printed on its front surface of the back in non-heat-transferable ink.

10. A greeting card, as set forth in claim 6, in which said folder is formed by a single sheet of paper on one side of which is printed said front page and on whose opposite side is printed said back page, said sheet being then folded to half.

11. A greeting card as set forth in claim 10, in which the sheet is formed of paper stock.

12. A greeting card as set forth in claim 1, in which the transferable ink in which the image of the character is printed on the decal section is a water-tranferable ink, and the decal section is formed of paper, the image being transferred to the surface by placing the decal section on the surface and applying water to the decal section which is absorbed by the paper to cause the image to transfer to the surface.

13. A greeting card as set forth in claim 12, in which the decal section is coated with a water-soluble adhesive layer on which the image is printed, the character image being transferred when the layer is made wet.

14. A greeting card as set forth in claim 13, in which the image is a simulated tattoo which is applied to a skin surface thereon.

15. A greeting card as set forth in claim 13, in which the water-transferable ink includes a polyester resin and a coloring agent.

* * * * *